United States Patent [19]

Dumas

[11] 4,408,208

[45] Oct. 4, 1983

[54] DIP BRAZED CORRUGATED FEED HORN

[75] Inventor: Theodore A. Dumas, Dallas, Tex.

[73] Assignee: Rockwell International Corporation, El Segundo, Calif.

[21] Appl. No.: 246,520

[22] Filed: Mar. 23, 1981

[51] Int. Cl.[3] ..... H01Q 13/02

[52] U.S. Cl. ..... 343/786

[58] Field of Search ..... 343/786, 772, 776

[56] References Cited

FOREIGN PATENT DOCUMENTS 53-41155 3/1978 Japan ..... 343/786

OTHER PUBLICATIONS

Davis, Corrugations Improve Monopulse Feed Horns, Microwaves, Apr. 1972, pp. 58, 59, 60.

*Primary Examiner*—Eli Lieberman

*Attorney, Agent, or Firm*—Michael E. Taken; V. Lawrence Sewell; Howard R. Greenberg

[57] ABSTRACT

A corrugated feed horn and its method of manufacture is disclosed for circularly polarized SHF (super high frequency) and EHF (extra high frequency) parabolic antennas operating in the 12–100 GHz range. A plurality of laminations are dip braze bonded, providing alternate fins and grooves in an inner conical configuration. Extremely thin fins are enabled without expensive parts or fabrication methods.

10 Claims, 5 Drawing Figures

DIP BRAZED CORRUGATED FEED HORN

TECHNICAL FIELD

The invention relates to corrugated feed horns for circularly polarized antennas, including SHF (super high frequency) and EHF (extra high frequency) parabolic antennas operating in the 12–100 GHz range. At these frequencies, the feed horns are small in diameter and require thin internal annular fins with deep grooves therebetween.

BACKGROUND

Corrugated feed horns improve the performance of circularly polarized parabolic antennas by providing nearly identical patterns for E and H planes. A corrugated feed horn with fins or lands much narrower than the grooves therebetween provides optimum RF performance. The fins and grooves alternate in an inner conical configuration.

At lower frequencies, feed horns can be made in a variety of ways, including machining. At SHF and EHF frequencies, the feed horns become small in diameter, and require thin fins and relatively deep grooves. This precludes machining because it is difficult and costly to machine the extremely thin fins, and because such machined thin fins commonly break off.

One method of making a feed horn with thin inner annular fins, is by electroforming. In this method, a conical mandrel is provided; and alternate layers of aluminum and copper washer-like flat annular rings of decreasing diameter are stacked along the mandrel. The outer periphery of the assembly is then electrocoated with copper to bond the layered rings, and the mandrel is removed. The assembly is then dipped in an etching acid solution to remove the aluminum and leave the copper rings as inner peripheral annular fins or lands with grooves therebetween. This method is subject to high tooling and piece-part costs.

Other methods include soldering and die casting. Die casting is subject to high tooling costs. Soldering is economical but weak because of poor tensile strength.

SUMMARY

The present invention provides an improved corrugated feed horn for a circularly polarized antenna. The feed horn utilizes inexpensive components, and is made by an economical method of manufacture, whereby to provide significant cost savings. The invention is particularly advantageous in SHF and EHF applications requiring extremely thin fins in the inner conical corrugated configuration.

The feed horn is made by dip brazing a plurality of laminations providing alternate fins and grooves in an inner conical configuration. A brazed feed method is provided which prevents build-up of brazed material in the grooves. The design further provides a method of adding open radial slots in the horn as a receive port for intermediate signal pick-off.

DETAILED DESCRIPTION

Figures 1, 3:
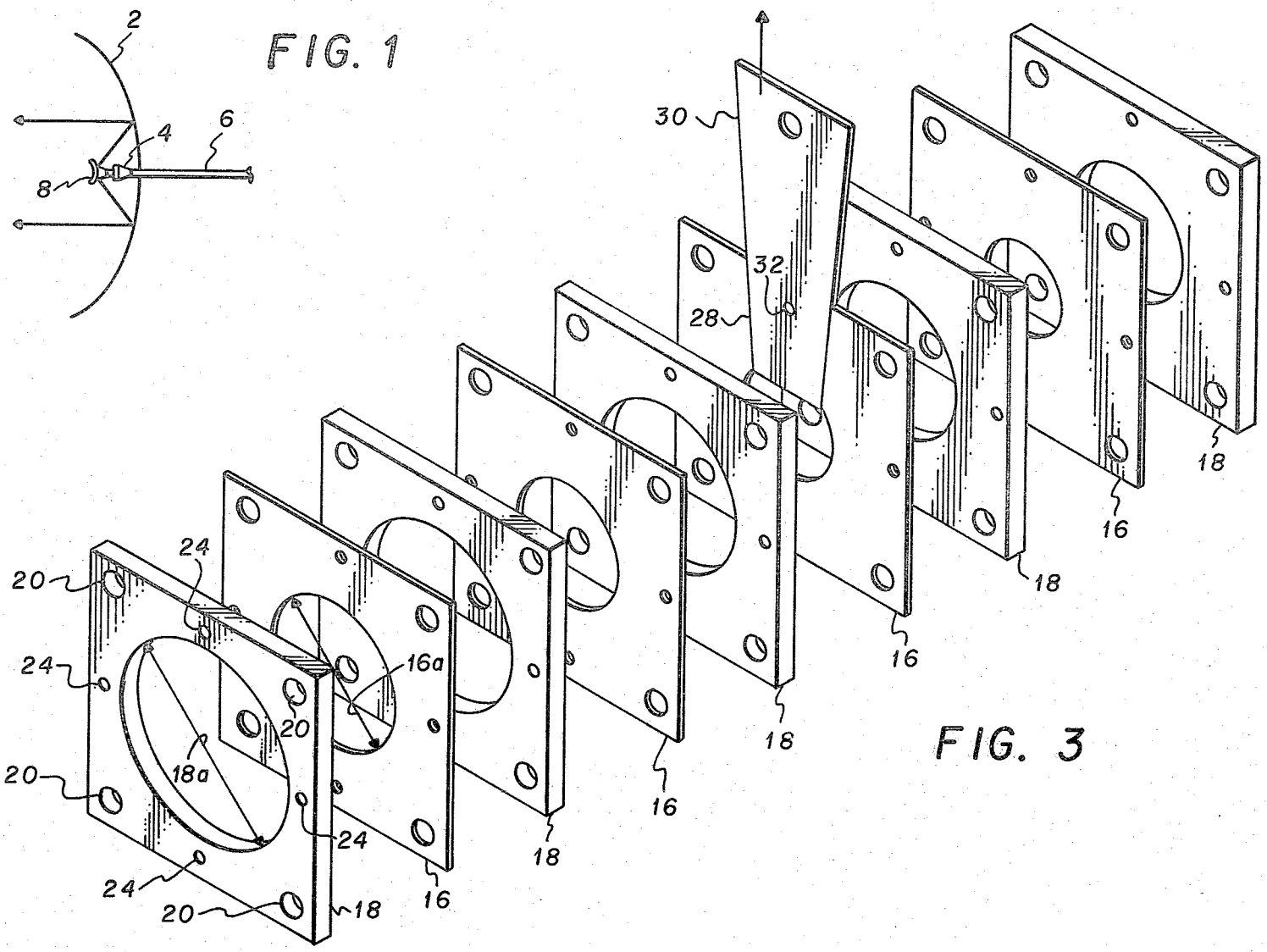
FIG. 1 is a schematic illustration of a feed horn and parabolic antenna.
FIG. 3 is an exploded pictorial illustration of a portion of the laminated assembly of FIG. 2 prior to manufacture.

FIG. 1 illustrates a parabolic antenna 2 fed by a feed horn 4. The signal to be transmitted is supplied along feed tube 6 to the feed horn and is then reflected from hyperbola 8 to the concave surface of parabolic antenna 2 which sends the signal out in a specified direction. The span of parabolic dish 2 is typically 2 to 5 feet.

Figure 2:
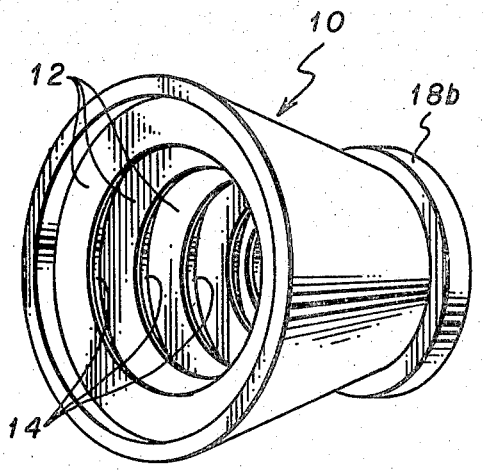
FIG. 2 is a pictorial illustration of a corrugated feed horn constructed in accordance with the invention.

FIG. 2 shows a corrugated feed horn 10 constructed in accordance with the invention for a circularly polarized SHF/EHF (super and extra high frequency) parabolic antenna operated in the 12–100 GHz range. Feed horn 10 has an inner conical configuration provided by alternate thin fins 12 and grooves 14 therebetween.

Figure 5:
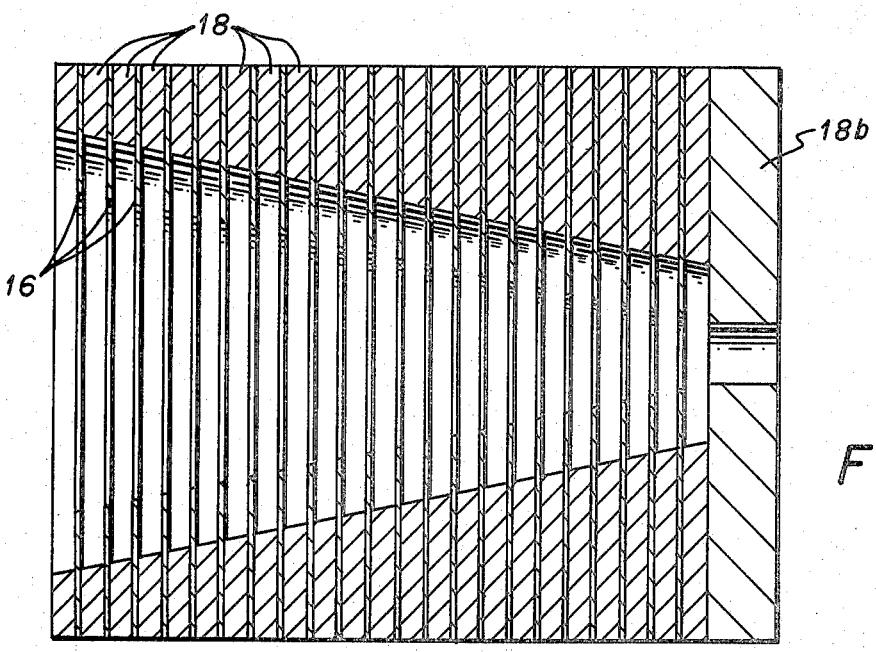
FIG. 5 is a cross-sectional view taken along line 5—5 of FIG. 4 after dip brazing.

Referring to FIG. 3, the fins and grooves of the feed horn are formed by a plurality of laminations provided by alternating fin plates 16 and groove plates 18. In FIG. 3, the inner diameter 16*a* of the fin plates decreases from left to right to thus form a conical profile in cross-section, as seen in FIG. 5. Likewise, the inner diameter 18*a* of the groove plates decreases from left to right in FIG. 3 to thus form a conical profile in cross section. In the particular embodiment disclosed, the diameter of the feed horn at its widest left end is about three inches, and the diameter at the small right end is as low as about one-quarter inch. The constituent material of laminations 16 and 18 is 6061-T6 aluminum. The thickness of fin plates 16 is on the order of 0.010 to 0.020 inch. The thickness of groove plates 18 is on the order of 0.05 inch or greater.

Figure 4:
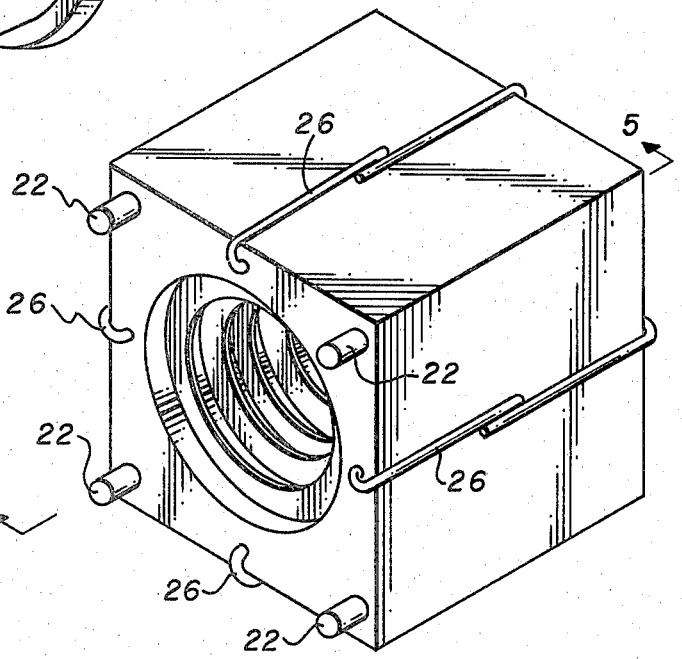
FIG. 4 is a pictorial illustration of the laminations of FIG. 3 in assembled condition.

Tooling holes 20 are formed at the four corners of the laminations for receiving dowel pins 22, FIG. 4, which align the laminations in stacked registry when assembled. Pins 22 are 304 stainless steel. The laminations also have a plurality of spaced sets of aligned apertures 24 for receiving braze metal wire 26, such as 4047 aluminum.

The assembly in FIG. 4 is dipped in a molten salt solution heated above the melting point of wires 26 but below the melting point of laminations 16 and 18. For the constituent materials noted above, the temperature of the salt solution is 1080°–1095° F. Each braze metal wire 26 melts in the solution and creeps or wicks by capillary action along the interfaces between the laminations. The wires are thin enough that there is not enough material to creep into the grooves between the fins along the inner conical surface of the horn. This wicking inward from the outside thus facilitates prevention of braze material build-up in the grooves.

The stainless steel dowel pins 22 are braze resistant, and are removed after the dip brazing to yield the assembled horn shown in FIG. 5. The right-most groove plate 18*b* is thicker than the remaining groove plates. The outer surface of the assembly in FIG. 5 is machined to a conical periphery down to base 18*b* to provide the horn shown in FIG. 2.

One or more open radial slots may be provided in the feed horn to afford a receive port for intermediate signal pick-off. One of the laminations is provided with a cut-out section 28, FIG. 3, from its inner to its outer periphery. A braze resistant tab 30, for example made from stainless steel, is inserted in cut-out section 28 prior to the above noted dip brazing. After dip brazing, the tab is removed to leave an open radial slot. Tab 30 has an aperture 32 which aligns with the respective set of aligned lamination apertures 24 when tab 30 is inserted in cut-out section 28. The respective braze metal wire 26 may thus be run through aligned apertures 24 and 32.

It is recognized that various modifications are possible within the scope of the appended claims.

I claim:

1. A method for making a corrugated feed horn for an antenna, comprising:

dip brazing a plurality of laminations providing alternate fins and grooves including controlling a braze metal to creep along the interfaces between the laminations, while preventing buildup of the metal in the grooves, said brazing including providing aligned apertures in said laminations;

running braze metal wire through said aligned apertures; and melting said wire by dipping said laminations in a solution heated above the melting point of the wire but below the melting point of the laminations.

2. The invention according to claim 1 comprising:

providing a plurality of sets of said aligned apertures in said laminations;

running braze metal wires through said sets of aligned apertures, such that each wire melts in said solution and creeps by capillary action along the interfaces between said laminations; and providing said wires thin enough that there is not enough material to creep into said grooves between said fins.

3. A method for making a corrugated feed horn for an antenna, comprising dip brazing a plurality of laminations providing alternate fins and grooves, including providing a cut-out section in one of said laminations to afford an open slot receive port in said horn for intermediate signal pick-off.

4. The invention according to claim 3 comprising:

inserting a braze-resistant tab in said cut-out section of said one lamination prior to said brazing; and removing said tab after said brazing, to leave said open slot.

5. The invention according to claim 4 comprising:

providing a plurality of sets of aligned apertures in said laminations, one set aligned through said cut-out section of said one lamination;

providing an aperture in said tab which aligns with said one set of aligned lamination apertures when said tab is inserted in said cut-out section of said one lamination;

running braze metal wires through said sets of aligned apertures; and melting said wires by dipping said laminations in a solution heated above the melting point of the wires but below the melting point of the laminations.

6. A corrugated feed horn for an antenna, comprising:

a plurality of laminations providing alternate fins and grooves, the laminations being bonded by braze metal but having no substantial excess of said metal in the grooves, and having aligned apertures receiving braze metal wire melted to creep by capillary action along the interfaces between the laminations.

7. The invention according to claim 6 wherein said laminations having a plurality of sets of said aligned apertures, each receiving a braze metal wire, and wherein each said wire is thin enough that there is not enough material to creep into said grooves between said fins.

8. A corrugated feed horn for an antenna, comprising:

a plurality of braze bonded laminations providing alternate fins and grooves with a slot receive port in said horn for intermediate signal pick-off provided by a cut-out section in one of said laminations.

9. The invention according to claim 8 wherein said cut-out section of said one lamination has a braze-resistant tab inserted therein during brazing to leave an open slot upon removal of said tab after said brazing.

10. The invention according to claim 9 wherein:

said tab has an aperture which aligns with one of said sets of aligned lamination apertures when said tab is inserted, such that the respective braze metal wire extends through said aperture in said tab.

* * * * *